US011725381B2

(12) United States Patent
Ehrman et al.

(10) Patent No.: US 11,725,381 B2
(45) Date of Patent: Aug. 15, 2023

(54) OPENWORK SPACER FOR USE WITHIN AN EXTERIOR BUILDING STRUCTURE

(71) Applicant: Benjamin Obdyke Incorporated, Horsham, PA (US)

(72) Inventors: Geoffrey Ehrman, Doylestown, PA (US); George Caruso, Ambler, PA (US)

(73) Assignee: Benjamin Obdyke Incorporated, Horsham, PA (US)

( * ) Notice: Subject to any disclaimer, the term of this patent is extended or adjusted under 35 U.S.C. 154(b) by 0 days.

(21) Appl. No.: 17/139,446

(22) Filed: Dec. 31, 2020

(65) Prior Publication Data

US 2021/0207365 A1 Jul. 8, 2021

Related U.S. Application Data

(60) Provisional application No. 62/956,727, filed on Jan. 3, 2020.

(51) Int. Cl.

| | |
|---|---|
| ***E04B 1/70*** | (2006.01) |
| ***E04D 13/17*** | (2006.01) |
| ***E04F 13/08*** | (2006.01) |
| ***E04F 13/00*** | (2006.01) |

(52) U.S. Cl.

CPC ..... *E04B 1/7069* (2013.01); *E04D 13/17* (2013.01); *E04F 13/007* (2013.01); *E04F 13/0819* (2013.01); *E04F 13/0864* (2013.01)

(58) Field of Classification Search

CPC ..... E04B 1/7069; E04D 13/17; E04D 12/002; E04F 13/007; E04F 13/0819; E04F 13/0864; E04F 13/0817

See application file for complete search history.

(56) References Cited

U.S. PATENT DOCUMENTS

| | | | |
|---|---|---|---|
| 4,805,367 | A | 2/1989 | Kleckner |
| 5,826,390 | A | 10/1998 | Sacks |
| 6,233,890 | B1 | 5/2001 | Tonyan |
| 6,357,193 | B1 | 3/2002 | Morris |
| 6,594,965 | B2 | 7/2003 | Coulton |
| 6,938,383 | B2 | 9/2005 | Morris et al. |
| 7,470,094 | B2 | 12/2008 | Heathcott et al. |
| 7,617,638 | B1 | 11/2009 | Slama et al. |
| 7,765,754 | B2 | 8/2010 | Johnson et al. |
| 9,566,775 | B2 | 2/2017 | Li et al. |

(Continued)

*Primary Examiner* — Patrick J Maestri

(74) *Attorney, Agent, or Firm* — Howson & Howson LLP

(57) ABSTRACT

An exterior wall or roof of a building comprises an inner sheathing member having an exterior facing surface, an outer building material installed adjacent and covering the exterior facing surface of the inner sheathing member, and a spacer secured between the inner sheathing member and the outer building material. The spacer is a continuous length of material formed by at least a first parallel set of ribs extending diagonally relative to a second parallel set of ribs thereby forming an openwork lattice structure. The first set of ribs forms a front face of the material, the second set or additional set of ribs forms a rear face of the material, and the first and second set of ribs are interconnected intermediate of the front and rear faces. Each of the first and second set of ribs extend diagonally relative to horizontal and vertical directions within the wall or roof.

16 Claims, 6 Drawing Sheets

(56) References Cited

U.S. PATENT DOCUMENTS

| | | | | |
|---|---|---|---|---|
| 9,797,142 | B1 * | 10/2017 | Sacks | E04C 2/06 |
| 2002/0124507 | A1 * | 9/2002 | Atkins | E04D 12/002 52/407.3 |
| 2004/0112007 | A1 * | 6/2004 | Thibeau | E04F 13/007 52/782.1 |
| 2012/0047844 | A1 * | 3/2012 | Walker | B32B 21/02 428/105 |
| 2018/0127983 | A1 | 5/2018 | Roy et al. | |
| 2018/0209140 | A1 * | 7/2018 | Hoggatt | E04B 1/70 |

* cited by examiner

OPENWORK SPACER FOR USE WITHIN AN EXTERIOR BUILDING STRUCTURE

CROSS REFERENCE TO RELATED APPLICATIONS

This application claims the benefit under 35 USC § 119(e) of U.S. Provisional Patent Application No. 62/956,727 filed Jan. 3, 2020.

BACKGROUND

Moisture which is permitted to accumulate within a building structure, such as within an exterior wall or roof of a building, will cause deterioration of the building structure. Thus, the present invention relates to providing drainage and ventilation within an exterior wall or the like of a building to prevent accumulation of moisture, and more particularly, the present invention relates to an openwork spacer for use within an exterior wall or the like of a building structure.

SUMMARY

According to the present invention, an exterior wall or roof structure of a building comprises an inner sheathing member having an exterior facing surface, an outer building material installed adjacent and covering the exterior facing surface of the inner sheathing member, and a spacer secured between the inner sheathing member and the outer building material spacing the inner sheathing member from the outer building material. The spacer is a continuous length of material defining opposite front and rear faces along the length and being formed by at least a first parallel set of ribs extending diagonally relative to a second parallel set of ribs thereby forming an openwork lattice structure. The first parallel set of ribs forms one of the front and rear faces of the material, the second parallel set of ribs forms the other of the front and rear faces of the material, and the first parallel set of ribs and the second parallel set of ribs are interconnected intermediate of the opposite front and rear faces. Each of the first parallel and second parallel set of ribs extend diagonally relative to horizontal and vertical directions within the wall structure or a direction of inclination of a wall or roof structure.

According to another aspect of the present invention, an openwork spacer is provided. The spacer is for use in spacing an inner sheathing member from an outer building material of an exterior wall structure of a building and can be provided in the form of a whole wall rainscreen product or a furring strip. The spacer comprises a continuous length of material defining opposite front and rear faces along the length and being formed by a first parallel set of ribs extending diagonally relative to a second parallel set of ribs thereby forming an openwork lattice structure. The first parallel set of ribs forms one of the front and rear faces of the material, the second parallel set of ribs forms the other of the front and rear faces of the material, and the first parallel set of ribs and the second parallel set of ribs are interconnected intermediate of the opposite front and rear faces. Accordingly, the spacer is bi-planar in which the first parallel set of ribs extends entirely within a first plane, the second set of parallel ribs extends entirely within a second plane, the first and second planes are adjacent and parallel, and the first parallel set of ribs and the second set of parallel ribs interconnect at the junction of the first plane and the second plane. According to another embodiment, the spacer may be tri-planar or more and may include three or more sets of ribs.

According to a further aspect of the present invention, a method of making an openwork spacer is provided. A continuous length of material having opposite front and rear faces along the length is provided by bonding a first parallel set of ribs to a second parallel set of ribs to produce an openwork lattice structure. The first parallel set of ribs forms one of the front and rear faces of the material, the second parallel set of ribs forms the other of the front and rear faces of the material, and the first parallel set of ribs and the second parallel set of ribs are interconnected intermediate of the opposite front and rear faces. A plurality of spaced-apart grooves extending in and transversely across the ribs of at least one of the first parallel set of ribs and the second parallel set of ribs are formed to form open drainage channels extending transversely across the ribs along at least one of the opposite front and rear faces.

DETAILED DESCRIPTION

According to an embodiment, an openwork spacer is provided in the form of a so-called geonet, i.e., a geosynthetic material consisting of an integrally connected parallel set of ribs or filaments overlying a similar parallel set of ribs or filaments at an angle forming an openwork, lattice structure. According to other embodiments, the space may include three or more sets of ribs or filaments.

According to another embodiment, the above referenced openwork spacer may be used as a furring strip within an exterior wall or roof of a building. According to a further embodiment, the openwork spacer may be applied across substantially the whole wall or roof as a full rainscreen product, and according to a still further embodiment, a method of making the openwork spacer is provided.

Figure 1:
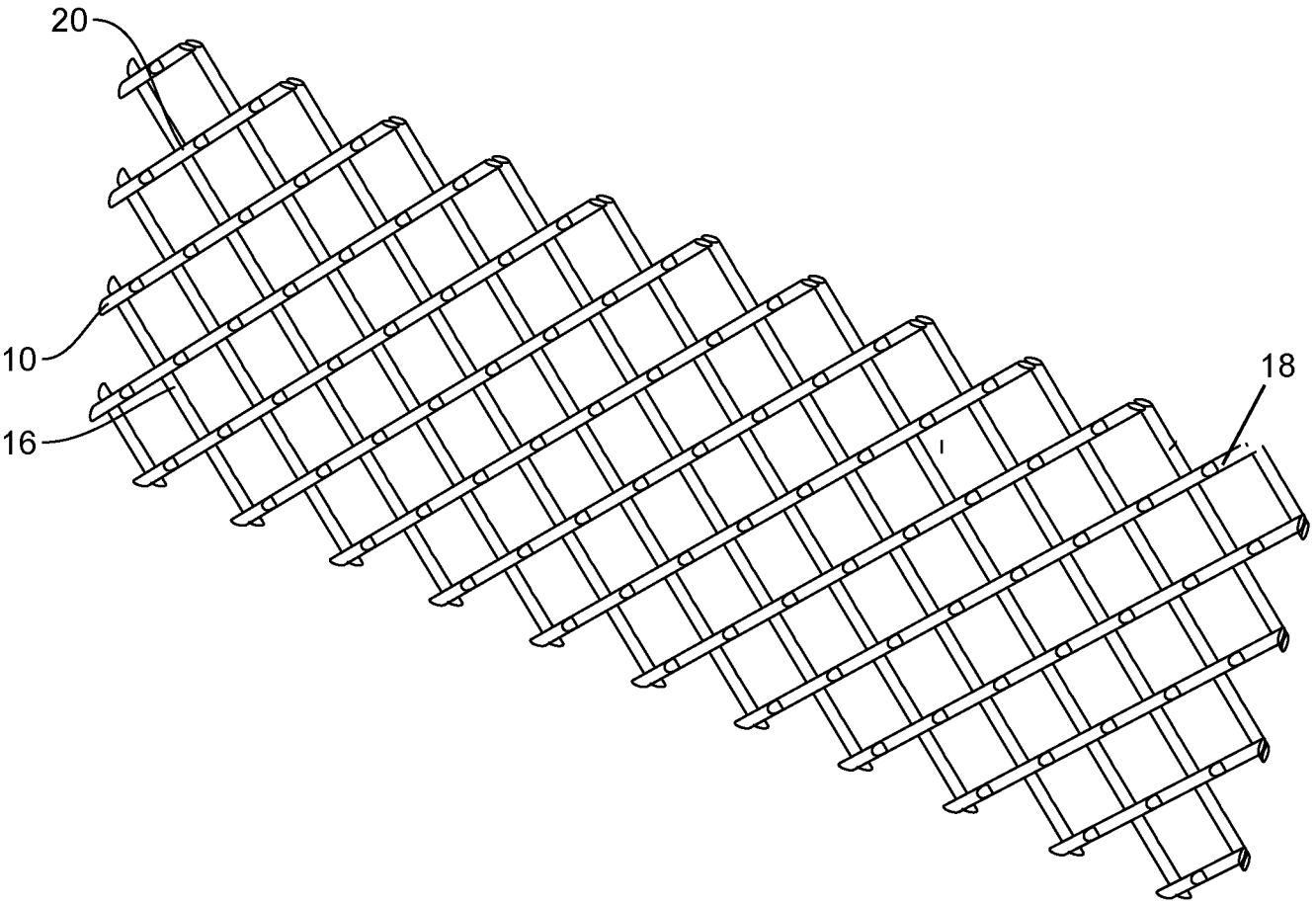
FIG. 1 is a perspective view of a geonet spacer product according to an embodiment.
Figure 2:
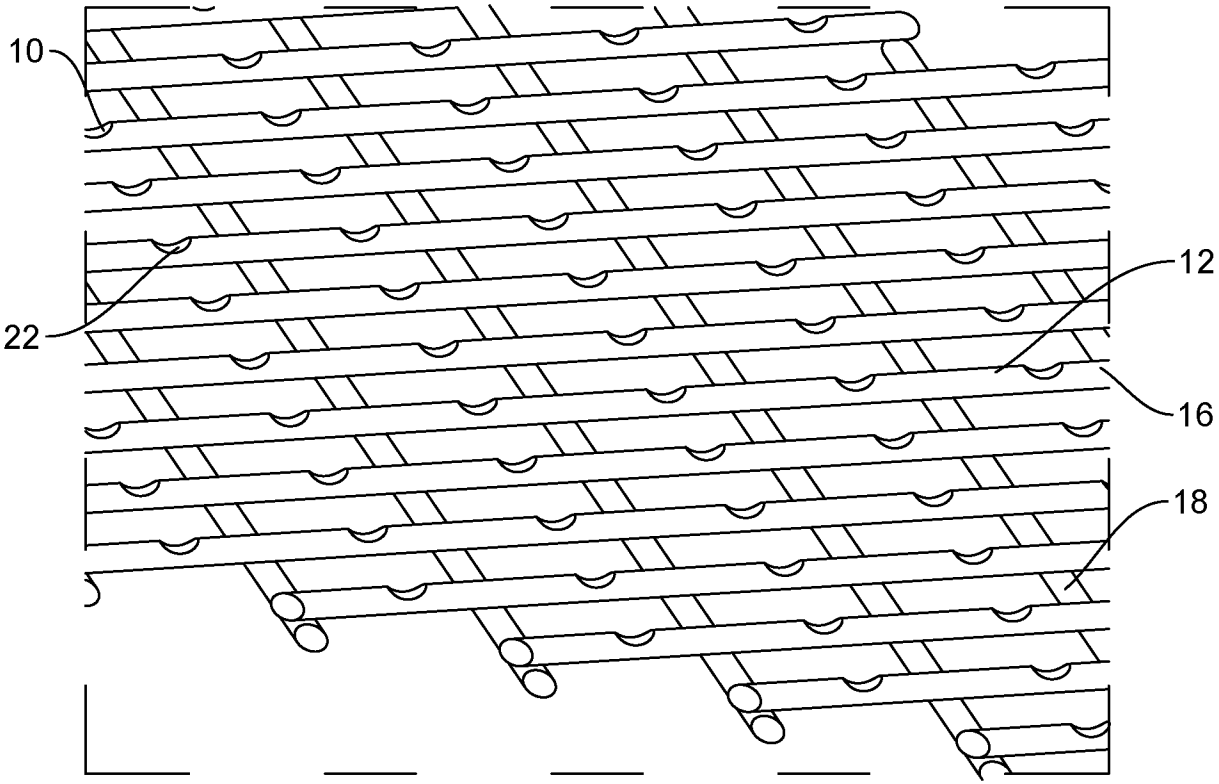
FIG. 2 is a magnified view of a front face of the geonet spacer product of FIG. 1.
Figure 3:
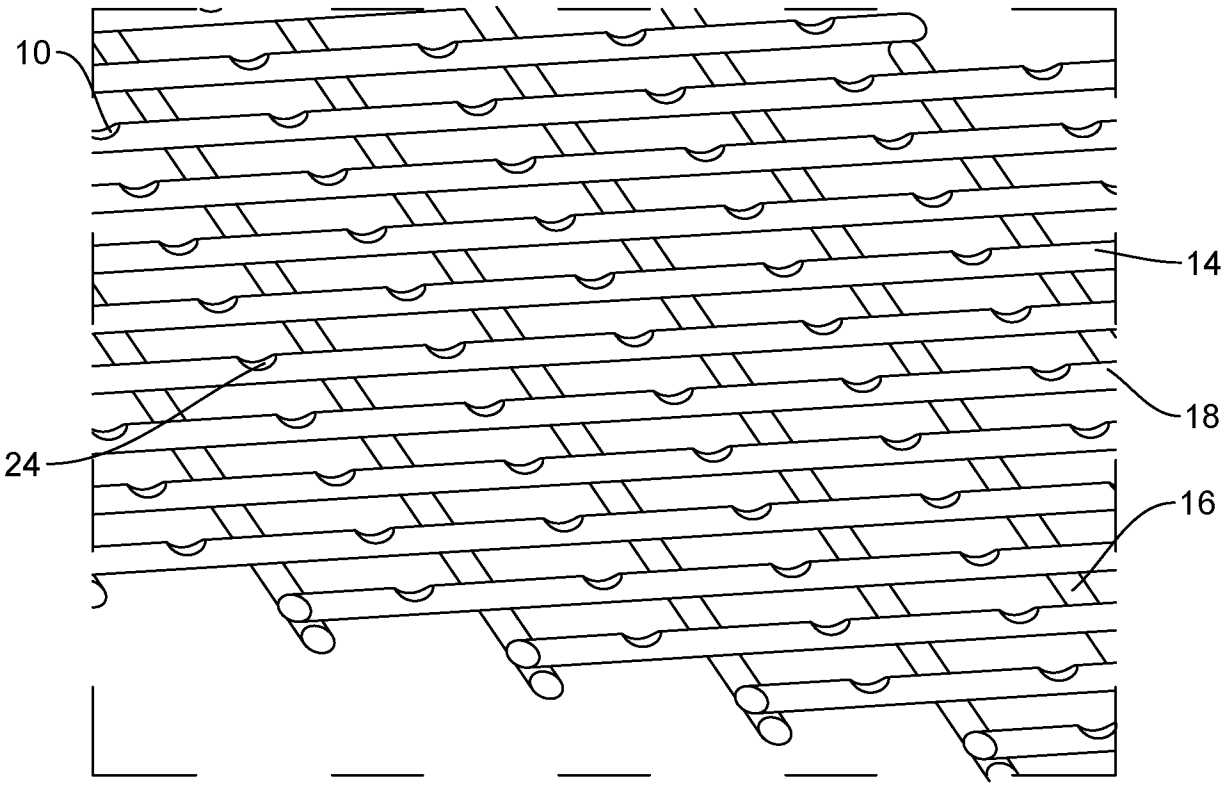
FIG. 3 is a magnified view of a rear face of a geonet spacer product of FIG. 1.

As best shown in FIGS. 1-3, one embodiment of an openwork spacer 10 comprises a continuous length (L) of material defining opposite front and rear faces, 12 and 14, along the length and is formed by a first parallel set of ribs 16 extending over and diagonally relative to a second parallel set of ribs 18 thereby forming an openwork lattice structure 20. The first parallel set of ribs 16 forms the front face 12 of the material (see FIG. 2), the second parallel set of ribs 18 forms the rear face 14 of the material (see FIG. 3), and the first parallel set of ribs 16 and the second parallel set of ribs 18 are interconnected intermediate of the opposite front and rear faces, 12 and 14, such that the spacer 10 is bi-planar in which the first parallel set of ribs 16 extend entirely within a first plane, the second set of parallel ribs 18 extend entirely within a second plane, the first and second planes are adjacent and parallel, and the first parallel set of ribs 16 and the second set of parallel ribs 18 interconnect at the junction of the first plane and the second plane. Other contemplated embodiments may have three or more sets of ribs and may be tri-planar or more.

According to one embodiment of a spacer 10, a plurality of spaced-apart grooves, 22 and 24, extends in and transversely across the ribs of at least one of the first parallel set of ribs 16 and the second parallel set of ribs 18 to form open drainage channels extending across the ribs along at least one or both of the opposite front and rear faces, 12 and 14. When the spacer 10 is applied within a wall structure, the ribs extend diagonally relative to horizontal and vertical directions within the wall. Accordingly, when the spacer is applied within a wall, the grooves, 22 and 24, permit moisture to drain in a more direct substantially downward path within the wall instead of along the full length of a diagonally extending rib. The grooves, 22 and 24, can be uniformly spaced-apart by about 0.5 inch to 2 inches or a different distance on each rib or randomly spaced apart. According to another embodiment of the spacer, no grooves are provided.

Figure 4:
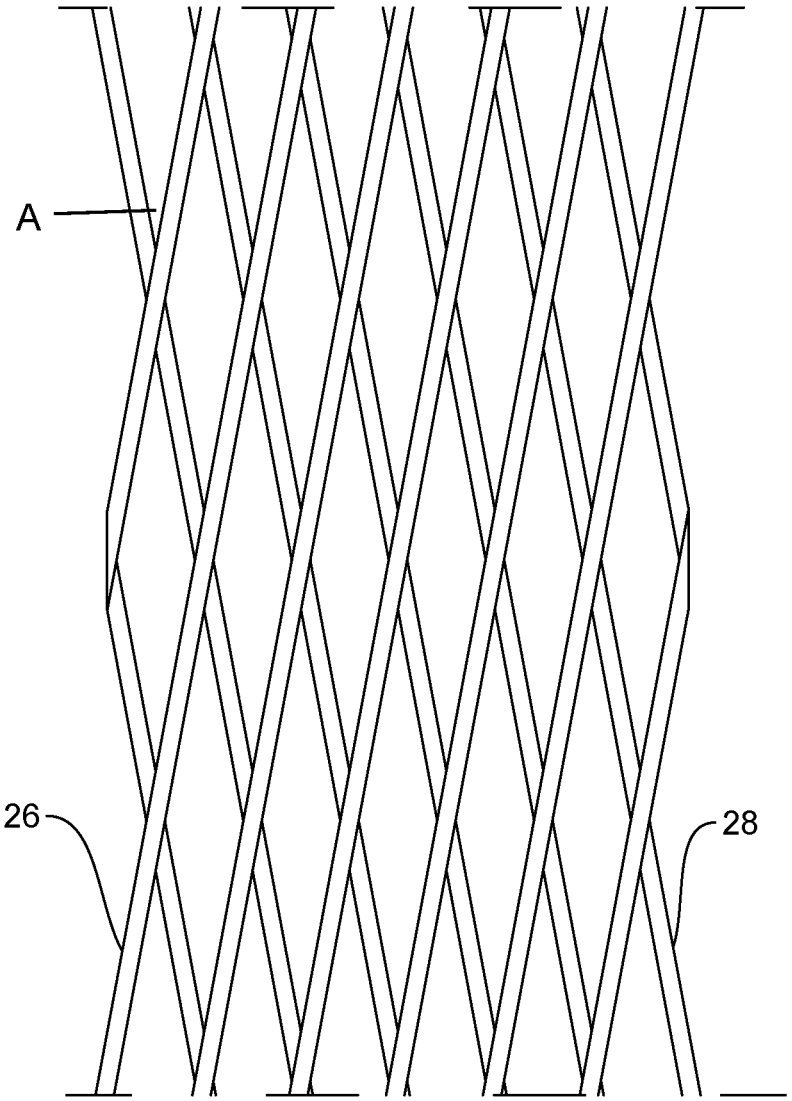
FIG. 4 is an elevational view of a geonet spacer product according to an embodiment

The first parallel set of ribs 16 and the second parallel set of ribs 18 may be made of a synthetic resin, such as high-density polyethylene (HDPE). According to embodiments of the spacer 10, the first parallel set of ribs 16 extend diagonally at an angle of about 30° to 45° relative to the second parallel set of ribs 18. In an alternate embodiment as shown schematically in FIG. 4, the first parallel set of ribs 26 extend diagonally at an angle "A" of about 30° or less relative to the second parallel set of ribs 28.

In addition, the spacer is provided such that it has a compression strength of at least 10,000 pounds per square foot (psf). Accordingly, the manufactured thickness of the spacer need be only slightly greater than the expected installed thickness of the spacer which accounts for any loss of thickness expected when subject to the above referenced amount of compression between an inner sheathing member and an outer building material.

According to some embodiments, a housewrap material, felt, building paper, a water resistive membrane, or a vapor permeable membrane is pre-applied or secured to one of the first and second parallel set of ribs, 16 and 18, on one of the opposite front and rear faces, 12 and 14, before the spacer 10 is applied within a wall structure. Alternatively, the housewrap or like material can be applied separately before the spacer 10 is applied.

The openwork spacer may be manufactured by forming a continuous length of material having opposite front and rear faces along the length thereof by bonding a first parallel set of ribs 16 to a second parallel set of ribs 18 to produce an openwork lattice structure 20. The first parallel set of ribs 16 forms one of the front and rear faces, 12 and 14, of the material, the second parallel set of ribs 18 forms the other of the front and rear faces, 12 and 14, of the material, and the first parallel set of ribs 16 and the second parallel set of ribs 18 being interconnected intermediate of the opposite front and rear faces, 12 and 14. In addition, a plurality of spaced-apart grooves, 22 and 24, extending in and transversely across the ribs of at least one of the first parallel set of ribs 16 and the second parallel set of ribs 18 may be formed to provide open drainage channels extending across the ribs along at least one of the opposite front and rear faces, 12 and 14.

According to an embodiment, any of the above referenced spacers may be used in the construction of an exterior wall or roof structure or like assembly of a building. For example, an exterior wall structure of a building may include an inner sheathing member having an exterior facing surface, an outer building material installed adjacent and covering the exterior facing surface of the inner sheathing member, and a spacer secured and sandwiched between the inner sheathing member and the outer building material for spacing the inner sheathing member from the outer building material. Another example of an exterior structure of a building in which the spacer may be used is a roof or the like. By way of example and not by way of limitation, the outer building material may be siding, shingles, cladding, stucco, brick or a like building material, and the inner sheathing member may be plywood, chip board, a composite material, or similar construction material.

As described above, the spacer may be of a continuous length of material defining opposite front and rear faces and may be formed by a first parallel set of ribs extending diagonally relative to a second parallel set of ribs thereby forming an openwork lattice structure. The first parallel set of ribs forms one of the front and rear faces of the material, the second parallel set of ribs forms the other of the front and rear faces of the material, and the first parallel set of ribs and the second parallel set of ribs are interconnected intermediate of the opposite front and rear faces. Within the wall structure, each of the first parallel and second parallel set of ribs extend diagonally relative to horizontal and vertical directions. (See FIGS. 5 and 7).

Figure 5:
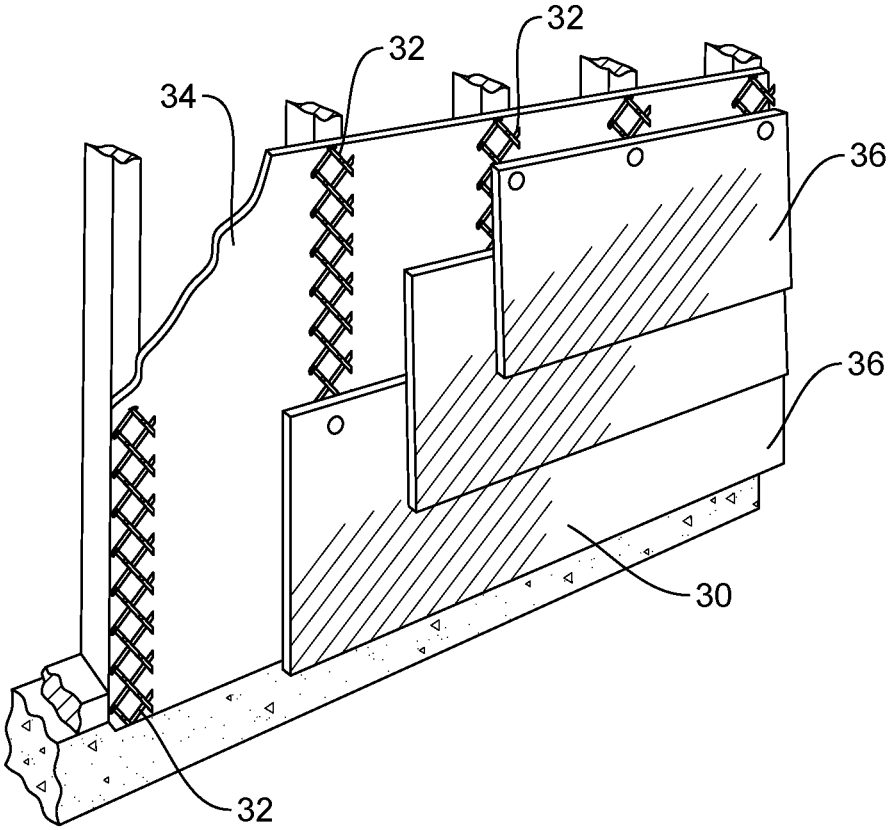
FIG. 5 is a perspective view of a wall structure according to an embodiment.
Figure 6:
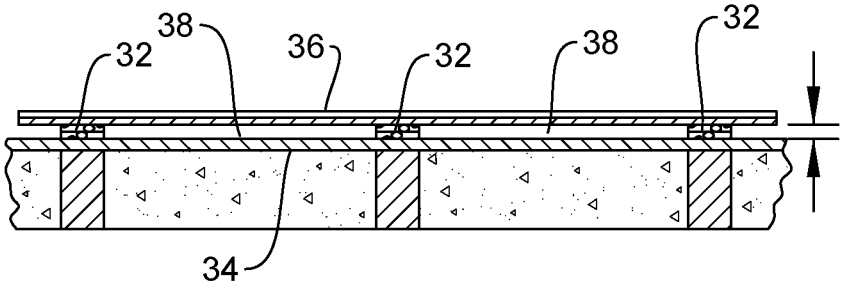
FIG. 6 is a cross-sectional view of the wall structure of FIG. 5.

As best shown in FIGS. 5 and 6, the spacer 10 may be provided in the form of an elongate furring strip 32. By way of example, and not by way of limitation, the length of the furring strip may be 4 to 8 feet, the width of the face of the furring strip may be 2 inches, and the thickness of the furring strip may be about 0.25 inch to 0.75 inch. Of course, these dimensions may be varied as desired. Thus, separate furring strips 32 are provided at spaced intervals within the wall 30 between the inner sheathing member 34 and the outer building material 36 and may be subject to compression forces when the outer building material 36 is secured with fasteners or the like to the inner sheathing member 34. The openwork lattice structure (with or without grooves) permits ventilation and drainage therethrough along both faces of the wall cavity 38 formed by and between the inner sheathing member 34 and the outer building material 36.

Figure 7:
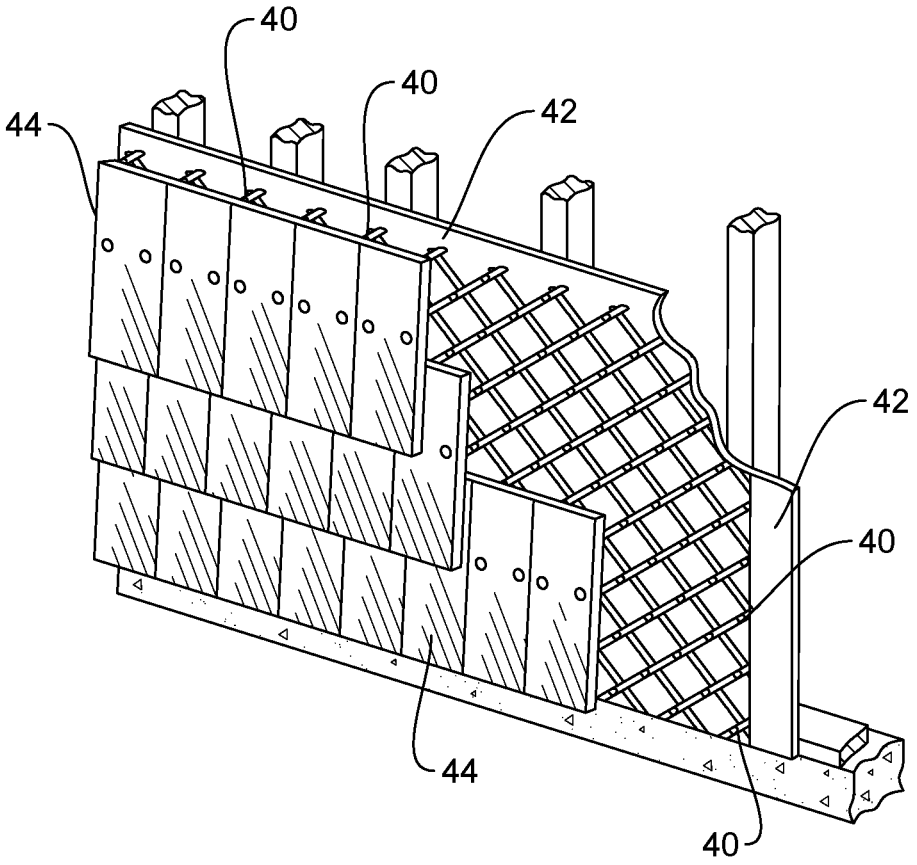
FIG. 7 is a perspective view of a wall structure according to an embodiment.
Figure 8:
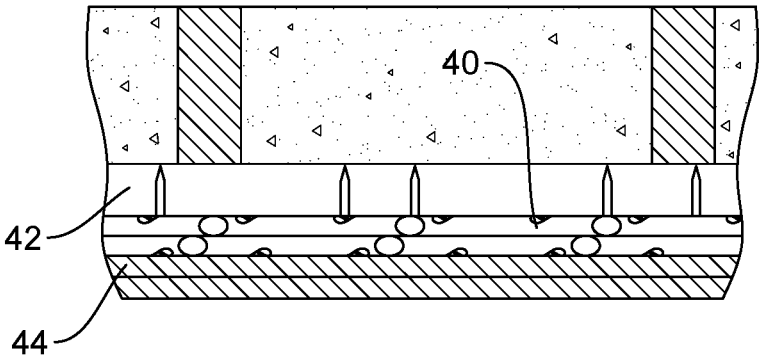
FIG. 8 is a cross-sectional view of the wall structure of FIG. 7.

As best shown in FIGS. 7 and 8, a spacer 40 may be provided in the form of a whole-wall rainscreen product such that it is installed and extends substantially throughout the entire cavity formed between the inner sheathing member 42 and outer building material 44.

According to other contemplated embodiments, the spacer may include a third parallel sets of ribs or may include more than three sets of ribs. For example, the spacer may have a tri-planar construction including a first parallel set of ribs, a second set of parallel ribs, and a third set of parallel ribs. The first parallel set of ribs may form a front face of the spacer, the third parallel set of ribs may form the rear face of the spacer, and the second parallel set of ribs may be sandwiched between the first and third parallel sets of ribs thereby forming a tri-planar structure. At least two of the sets of parallel ribs may extend diagonally relative to each other thereby forming an openwork lattice structure.

According to an embodiment the openwork lattice spacer may be made of a flexible polymer that facilitates providing the spacer in a spiral roll for storage and shipment to a jobsite. Thus, the furring strip and the whole-wall rainscreen product can be provided in a spiral roll and then unrolled and applied to a building structure.

While preferred embodiments of an openwork spacer, furring strip, rainscreen product, building structure and a method of making a spacer have been described, various modifications, alternations, and changes may be made without departing from the spirit and scope of the present invention as defined in the appended claims.

We claim:

1. An exterior wall or roof structure of a building, comprising:

an inner sheathing member having an exterior facing surface;

an outer building material installed adjacent and covering said exterior facing surface of said inner sheathing member; and a spacer secured between said inner sheathing member and said outer building material for spacing said inner sheathing member from said outer building material;

said spacer being a continuous length of material defining opposite front and rear faces along said length and being formed by at least a first parallel set of ribs extending transversely relative to a second parallel set of ribs thereby forming an openwork lattice structure;

said first parallel set of ribs forming one of said front and rear faces of said spacer, said second parallel set of ribs forming the other of said front and rear faces of said spacer, and said first parallel set of ribs and said second parallel set of ribs being interconnected intermediate of said opposite front and rear faces;

a plurality of spaced-apart grooves extends in and transversely across the ribs of at least one of the first parallel set of ribs and the second parallel set of ribs to form open drainage channels extending across the ribs along at least one of said opposite front and rear faces, said grooves being spaced from locations where said first parallel set of ribs and said second parallel set of ribs interconnect;

said ribs of said first and second parallel set of ribs being filaments that are made of a polymer and that have a substantially circular cross-section, and each of said plurality of spaced-apart grooves extending within the otherwise substantially circular cross-section such that each groove is formed by a channel cut into the otherwise substantially circular cross-section; and said spacer being sufficiently flexible to be storable and shippable in a spiral roll configuration.

2. The exterior wall or roof structure according to claim 1, wherein a plurality of spaced-apart grooves extend in and transversely across the ribs of both the first parallel set of ribs and the second parallel set of ribs to form open drainage channels extending across the ribs along both of said opposite front and rear faces.

3. The exterior wall or roof structure according to claim 1, wherein the first parallel set of ribs extend diagonally at an angle of 30° to 45° relative to the second parallel set of ribs.

4. The exterior wall or roof structure according to claim 1, wherein the first parallel set of ribs extend diagonally at an angle of 30° or less relative to the second parallel set of ribs.

5. The exterior wall or roof structure according to claim 1, wherein said spacer has a compression strength of at least 10,000 pounds per square foot (psf).

6. The exterior wall or roof structure according to claim 1, wherein the spacer is bi-planar such that the first parallel set of ribs extend entirely within a first plane, the second set of parallel ribs extend within a second plane, the first and second planes are adjacent and parallel, and the first parallel set of ribs and the second set of parallel ribs interconnect at the junction of the first plane and the second plane.

7. The exterior wall or roof structure according to claim 1, wherein at least one of a housewrap material, felt, building paper, a water resistive membrane, and a vapor permeable membrane extends on the exterior facing surface of the inner sheathing member between the spacer and the inner sheathing member, and wherein the outer building material includes at least one of siding, shingles, cladding, stucco, and brick.

8. An openwork spacer for spacing an inner sheathing member from an outer building material of an exterior wall or roof structure of a building, comprising:

a continuous length of material defining opposite front and rear faces along said length and being formed by a first parallel set of ribs extending transversely relative to a second parallel set of ribs thereby forming an openwork lattice structure, said first parallel set of ribs forming one of said front and rear faces of said material, said second parallel set of ribs forming the other of said front and rear faces of said material, and said first parallel set of ribs and said second parallel set of ribs being interconnected intermediate of said opposite front and rear faces such that the spacer is bi-planar in which the first parallel set of ribs extend entirely within a first plane, the second set of parallel ribs extend entirely within a second plane, the first and second planes are adjacent and parallel, and the first parallel set of ribs and the second set of parallel ribs interconnect at the junction of the first plane and the second plane;

a plurality of spaced-apart grooves extends in and transversely across the ribs of at least one of the first parallel set of ribs and the second parallel set of ribs to form open drainage channels extending across the ribs along at least one of said opposite front and rear faces, said grooves being spaced from locations where said first parallel set of ribs and said second parallel set of ribs interconnect;

said ribs of said first and second parallel set of ribs being filaments that have a substantially circular cross-section, and each of said plurality of spaced-apart grooves extending within the otherwise substantially circular cross-section such that each groove is formed by a channel cut into the otherwise substantially circular cross-section; and said spacer being rollable in a spiral roll for storage and shipment.

9. The spacer according to claim 8, wherein said spacer is in the form of a whole wall rainscreen product, wherein said spacer has a compression strength of at least 10,000 pounds per square foot (psf).

10. The spacer according to claim 8, wherein the first parallel set of ribs and the second parallel set of ribs are made of a polymer.

11. The spacer according to claim 8, wherein a plurality of spaced-apart grooves extends in and transversely across the ribs of both the first parallel set of ribs and the second parallel set of ribs to form open drainage channels extending across the ribs along both of said opposite front and rear faces.

12. The spacer according to claim 8, wherein the first parallel set of ribs extend diagonally at an angle of 30° to 45° relative to the second parallel set of ribs.

13. The spacer according to claim 8, wherein the first parallel set of ribs extend diagonally at an angle of 30° or less relative to the second parallel set of ribs.

14. The spacer according to claim 8, wherein at least one of a housewrap material, felt, building paper, a water resistive membrane, and a vapor permeable membrane is secured to one of said first and second parallel set of ribs on one of said opposite front and rear faces.

15. A method of making an openwork spacer for use in spacing an inner sheathing member from an outer building material of an exterior structure of a building, comprising the steps of:

forming a continuous length of material having opposite front and rear faces along said length by bonding a first parallel set of ribs to a second parallel set of ribs to produce an openwork lattice structure with the first parallel set of ribs forming one of the front and rear faces of the material, the second parallel set of ribs forming the other of the front and rear faces of said material, and the first parallel set of ribs and the second parallel set of ribs being interconnected intermediate of the opposite front and rear faces;

forming a plurality of spaced-apart grooves extending in and transversely across the ribs of at least one of the first parallel set of ribs and the second parallel set of ribs to form open drainage channels extending across the ribs along at least one of the opposite front and rear faces, said grooves being spaced from locations where said first parallel set of ribs and said second parallel set of ribs interconnect; and rolling said material in a spiral roll;

wherein said ribs of said first and second parallel set of ribs are filaments that are made of a polymer and that have a substantially circular cross-section, and each of said plurality of spaced-apart grooves extend within the otherwise substantially circular cross-section such that each groove is formed by a channel cut into the otherwise substantially circular cross-section.

16. The exterior wall or roof structure according to claim 1, wherein said first parallel set of ribs extend diagonally relative to said second parallel set of ribs, and wherein each of said first parallel and second parallel set of ribs extend diagonally relative to a horizontal direction or a direction of inclination of the exterior wall or roof structure.

* * * * *